US006280153B1

(12) United States Patent
Iversen et al.

(10) Patent No.: US 6,280,153 B1
(45) Date of Patent: Aug. 28, 2001

(54) SUCTION GAS CONDUIT FOR A REFRIGERATION COMPRESSOR

(75) Inventors: Frank Holm Iversen, Padborg; Preben Bjerre, Sønderborg, both of (DK)

(73) Assignee: Danfoss Compressors GmbH, Flensberg (DE)

( * ) Notice: Subject to any disclaimer, the term of this patent is extended or adjusted under 35 U.S.C. 154(b) by 0 days.

(21) Appl. No.: 09/566,706

(22) Filed: May 9, 2000

(30) Foreign Application Priority Data

May 22, 1999 (DE) ..... 199 23 733

(51) Int. Cl.[7] ..... F09B 39/00
(52) U.S. Cl. ..... 417/312; 417/572; 138/37
(58) Field of Search ..... 417/312, 572; 138/37, 39

(56) References Cited

U.S. PATENT DOCUMENTS 5,230,369 * 7/1993 Presz, Jr. ..... 138/39
5,577,898 * 11/1996 Lee ..... 417/312
5,613,842 * 3/1997 Alfano et al. ..... 417/312
5,762,478 * 6/1998 Lee ..... 417/312

* cited by examiner

*Primary Examiner*—Charles G. Freay
(74) *Attorney, Agent, or Firm*—Lee, Mann, Smith, McWilliams, Sweeney & Ohlson

(57) ABSTRACT

A suction gas conduit (1) for a refrigeration compressor has a curved section (4) of the gas path (2), which connects an inlet section (3) of the gas path to an outlet section (5). A widening (11) in the form of a step (12) is located on the inner side of the curve of the gas path. The curved section (4) especially abuts, at the outlet end, a valve plate (7) of the compressor, which valve plate (7) has a suction gas opening (6). The outer side of the curve of the gas path (2) is unimpeded. The step height (H) is from 0.3 to 1.0 times, and the step length (L) from 0.2 to 1.0 times, the hydraulic diameter (d) of the outlet section (5). As a result thereof, the unavoidable recirculation flow is located in a position where its undesirable effect is limited.

7 Claims, 1 Drawing Sheet

SUCTION GAS CONDUIT FOR A REFRIGERATION COMPRESSOR

The invention relates to a suction gas conduit for a refrigeration compressor, having a curved section which connects an inlet section of the gas path to an outlet section, there being provided a widening in the form of a step on the inner side of the curve of the gas path, the curved section especially abutting, at the outlet end, a valve plate of the compressor, which valve plate has a suction gas opening.

In a known construction of that kind (U.S. Pat. No. 5,577,898), an extension connected to a suction sound damper is held between a cylinder head cover and a valve plate. The end of the extension is in the form of a curved section which is bounded, on the outer side of the curve of the gas path, by two wall portions arranged at an angle to one another, through which there passes a capillary tube duct extending into the gas path. A step provided on the inner side of the curve is formed as a result of the fact that the outlet opening of the curved section has a larger cross-section than the suction gas opening in the valve plate. The purpose of that recess is not mentioned.

The problem underlying the invention is to reduce the flow resistance in the suction gas channel.

The problem is solved according to the invention by means of the fact that the outer side of the curve of the gas path is unimpeded and the step height is from 0.3 to 1.0 times, and the step length from 0.2 to 1.0 times, the hydraulic diameter of the outlet section.

As will be explained in greater detail hereinafter, the step, when it is correctly dimensioned, bounds a recirculation space, wherein the recirculation—which is unavoidable when there are marked changes in flow direction—takes place outside the outlet section so that the effective cross-section of the latter is not impeded or is impeded less markedly. That is achieved, however, only when no wall portions impeding the flow are present on the outer side of the curve.

Because almost the entire cross-section of the outlet section is available for the main flow, the refrigeration gas can flow in at a relatively low speed during the suction stroke. That reduces the noise produced and lowers the flow resistance, resulting in a relatively high degree of filling for the compressor.

Advantageously, the step height is from 0.3 to 0.8 times, and the step length from 0.4 to 0.8 times, the hydraulic diameter of the outlet section. The optimum can be determined by means of a few tests.

It is recommended that the curved section be smooth and approximately uniformly curved, as a result of which the diversion losses on the outer side of the curve are kept small.

In a preferred arrangement, it is arranged that the curved section abuts, at the outlet end, the end face of the valve plate and, for formation of the step, has an outlet opening larger than the suction gas opening. The step is accordingly obtained on the curved section by simple means.

Another, likewise preferred alternative consists in the fact that the valve plate has, for formation of the step, a recess larger than the suction gas opening, and the outlet opening of the curved section is matched to the size of the recess. In this instance, the step is formed with the aid of the valve plate, which is especially advantageous when there is a relatively thick valve plate.

The curved section can again abut the end face of the valve plate or is, especially advantageously, located in the recess by means of projecting wall portions.

In a modification based on the same principle it is arranged, according to the invention, that the widening is formed by an opening on the inner side of the curve, which opening opens into a suction sound damper chamber and has dimensions that correspond to the height and length of an imaginary step. Because the gas in the suction sound damper chamber is at approximately the same pressure as in the gas path, it is largely capable of replacing the claimed steps.

The invention is described below in greater detail with reference to preferred embodiments in conjunction with the drawings, in which.

Figure 1:
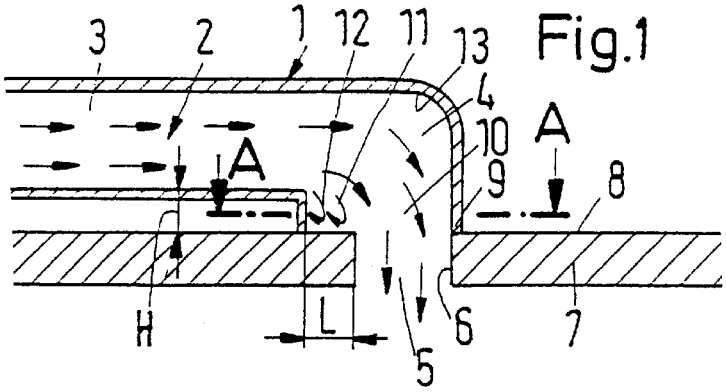
FIG. 1 shows a partial longitudinal section through a first embodiment of a suction gas conduit according to the invention.

FIG. 1 shows a suction gas conduit 1, the gas path 2 of which has an inlet section 3, a curved section 4 connected thereto and an outlet section 5. The latter is formed by a suction gas opening 6 in a valve plate 7 of a refrigeration compressor, the end face 8 of which valve plate 7 abuts the end face 9 of the curved section 4.

Figure 2:
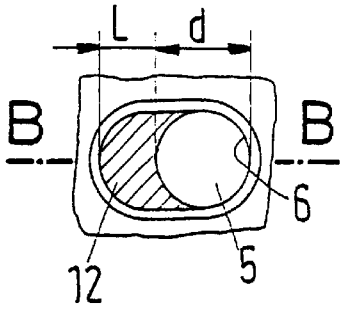
FIG. 2 shows a section along the line A—A in FIG. 1.

The outlet opening 10 of the curved section 4 is larger in cross-section than the suction gas opening 6. That results in a widening 11 of the gas path 2, which widening 11 has the shape of a step 12. In FIG. 2, that step is indicated by hatching.

According to the invention, the step has a step height H of from 0.3 to 1.0 times the hydraulic diameter d of the outlet section 6, preferably from 0.3 to 0.8 times the hydraulic diameter d. Furthermore, the step 12 has a step length L of from 0.2 to 1.0 times, and preferably from 0.4 to 0.8 times, the hydraulic diameter of the outlet section. Good results were obtained when the step height H was approximately 0.35 times, and the step length L approximately 0.5 times, the hydraulic diameter d of the outlet section. By means of such a widening 11, the recirculation zone, which is unavoidable in a bend, is located in a position where its undesirable effect is limited.

The step height H and the step length L are measured in the plane of symmetry B—B, more particularly the step height H being measured perpendicular to the centre axis of the inlet section 3 at the outlet thereof and the step length L being measured parallel to the said centre axis. Advantageously, the value of L is constant over the entire width of the step 12. The value H can increase, from a very small value, towards both sides, in the plane of symmetry B—B. The reference to the hydraulic diameter d means that the cross-sections of the gas path can be of a shape that is not only circular but also elliptical, rectangular or similar. The hydraulic diameter is calculated as $$d = \frac{4 \cdot A}{O},$$

where d is the hydraulic diameter, A is the cross-sectional area and O is the perimeter of the opening. Because the outlet section 5 has a circular cross-section in this arrangement, the hydraulic diameter d corresponds to the actual diameter.

The outer side 13 of the curve of the gas path 2 is smooth and of approximately uniformly curved construction.

Figure 3:
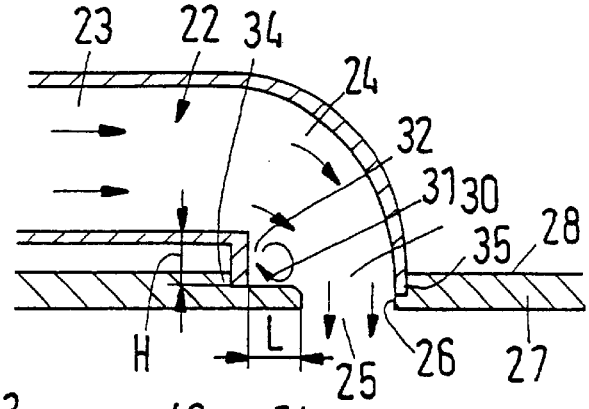
FIG. 3 shows a modified arrangement similar to what is shown in FIG. 1.

In the arrangement according to FIG. 3, reference figures that are higher by 20 than those in FIG. 1 are used for corresponding parts. In this instance, the step 32 is formed as a result of the fact that a recess 34 is provided in the valve plate 27, in which recess 34 wall portions 35 of the curved section 24 are located.

Figure 4:
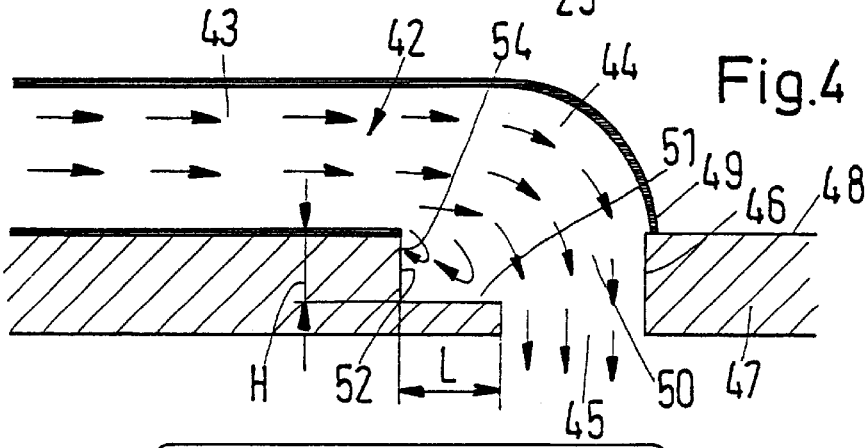
FIG. 4 shows a third arrangement similar to what is shown in FIG. 1.

In the arrangement according to FIG. 4, reference figures that are higher by 40 than those in FIG. 1 are used for corresponding parts. In the valve plate 47 there is a recess 54, which forms the widening 51 and the step 52. The end face 49 of the curved section 44 abuts the end face 48 so that the step formation is, in this instance, entirely assumed by the valve plate 47.

Figure 5:
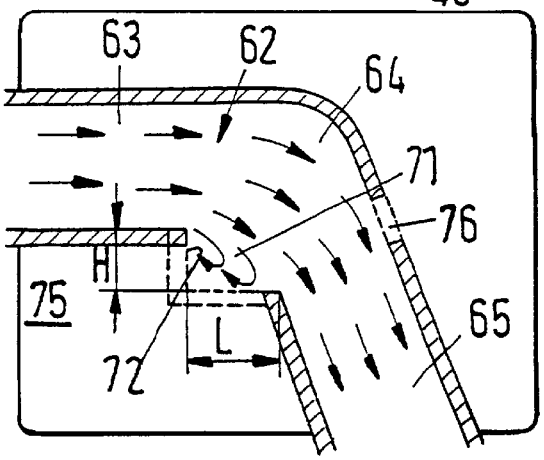
FIG. 5 shows a further embodiment.

In the arrangement according to FIG. 5, reference figures that are higher by 60 than those in FIG. 1 are used for corresponding parts. This arrangement relates to a suction gas conduit that runs inside a suction sound damper and in which the outlet section 65 is angled with respect to the inlet section 63, not by 90°, but by less, for example 70°. In this instance, the widening 71 is formed by an opening which opens into a suction sound damper chamber 75 and has dimensions that correspond to an imaginary step 72 (indicated by broken lines) having the step height H and step length L specified earlier. The outlet section 65 and curved section 64 can be constructed as separate parts. A broken connecting line 76 indicates that the said sections can also be constructed as one part.

What is claimed is:

1. Suction gas conduit for a refrigeration compressor, having a curved section which connects an inlet section of the gas path to an outlet section, the outlet section having a hydraulic diameter, and a widening in the form of a step on an inner side of a curve, of the curved section of the gas path, the curved section abutting, at an outlet end, a valve plate of the compressor, which valve plate has a suction gas opening, the curse of the gas path having an outer side which is unimpeded and the step having a height which is from 0.3 to 1.0 times and the step having a length which is from 0.2 to 1.0 times, the hydraulic diameter of the outlet section.

2. Suction gas conduit according to claim 1, in which the height is from 0.3 to 0.8 times, and the length is from 0.4 to 0.8 times, the hydraulic diameter of the outlet section.

3. Suction gas conduit according to claim 1, in which the curved section is smooth and generally uniformly curved.

4. Suction gas conduit according to claim 1, in which the curved section abuts, at the outlet end, the end face of the valve plate and, for formation of the step, the curved section has an outlet opening larger than the suction gas opening.

5. Suction gas conduit according to claim 1, in which the valve plate has, for formation of the step, a recess larger than the suction gas opening, and the curved section having an outlet opening which is matched to the size of the recess.

6. Suction gas conduit according to claim 5, in which the curved section extends in the recess by means of projecting wall portions.

7. A suction gas conduit for a refrigeration compressor, having a curved section which connects an inlet section of the gas path to an outlet section, the outlet section having a hydraulic diameter, and a widening on an inner side of a curve of the curved section of the gas path, the curved section abutting, at an outlet end, a valve plate of the compressor, which valve plate has a suction gas opening, the curve of the gas path having an outer side which is unimpeded and the widening is formed by an opening on an inner side of the curve, which opening opens into a suction sound damper chamber and which opening has dimensions that correspond to the height and length of an imaginary step, said imaginary step having a height which is from 0.3 to 1.0 times, and the step having a length which is from 0.2 to 1.0 times, the hydraulic diameter of the outlet section.

* * * * *